US009719239B2

(12) United States Patent
Bhardwaj et al.

(10) Patent No.: US 9,719,239 B2
(45) Date of Patent: Aug. 1, 2017

(54) DUAL-JET TOILET

(71) Applicant: Kohler India Corporation Private Limited, Bangalore, Karnataka (IN)

(72) Inventors: Arun Bhardwaj, Gurgaon (IN); Vivek Kumar Srivastava, Jaunpur (IN); Shyam Nandan Kumar, Begusarai (IN)

(73) Assignee: Kohler India Corporation Private Limited (IN)

( * ) Notice: Subject to any disclaimer, the term of this patent is extended or adjusted under 35 U.S.C. 154(b) by 136 days.

(21) Appl. No.: 14/659,035

(22) Filed: Mar. 16, 2015

(65) Prior Publication Data

US 2015/0267388 A1 Sep. 24, 2015

Related U.S. Application Data

(60) Provisional application No. 61/954,907, filed on Mar. 18, 2014.

(51) Int. Cl.

| | |
|---|---|
| ***E03D 11/08*** | (2006.01) |
| ***E03D 11/14*** | (2006.01) |
| ***E03D 11/13*** | (2006.01) |
| ***E03D 11/02*** | (2006.01) |

(52) U.S. Cl.

CPC ..... *E03D 11/08* (2013.01); *E03D 11/02* (2013.01); *E03D 11/135* (2013.01); *E03D 11/14* (2013.01); *E03D 2201/30* (2013.01); *E03D 2201/40* (2013.01)

(58) Field of Classification Search

CPC ..... E03D 11/02; E03D 11/08; E03D 11/135; E03D 11/14; E03D 11/143; E03D 11/146; E03D 2201/30; E03D 2201/40

USPC ..... 4/420, 421, 425

See application file for complete search history.

(56) References Cited

U.S. PATENT DOCUMENTS

| | | | |
|---|---|---|---|
| 26,243 | A | 11/1859 | Boch, Sr. |
| 97,105 | A | 11/1869 | Moore |
| 166,209 | A | 8/1875 | Leland |
| 172,571 | A | 1/1876 | Leland |
| 172,572 | A | 1/1876 | Leland |
| 188,897 | A | 3/1877 | Harrison |
| 206,049 | A | 7/1878 | Smith |
| 220,688 | A | 10/1879 | Wilson |
| 233,470 | A | 10/1880 | Burke |
| 243,329 | A | 6/1881 | Trested |
| 266,309 | A | 10/1882 | Pike |

(Continued)

FOREIGN PATENT DOCUMENTS

| | | | |
|---|---|---|---|
| CN | 1271291 | C | 8/2006 |
| CN | 201704771 | U | 1/2011 |

(Continued)

OTHER PUBLICATIONS

EP Extended Search Report for Application No. 15159722.6—12 pages.

(Continued)

*Primary Examiner* — J. Casimer Jacyna
(74) *Attorney, Agent, or Firm* — Foley & Lardner LLP

(57) ABSTRACT

A toilet includes a bowl having an opening, an outlet, and two jet holes positioned above a water line defined by a weir of a trapway. The two jet holes are configured to evacuate waste from the bowl into a drain.

21 Claims, 12 Drawing Sheets

(56) References Cited

U.S. PATENT DOCUMENTS

| | | | | |
|---|---|---|---|---|
| 273,668 | A | 3/1883 | Connolly | |
| 303,027 | A * | 8/1884 | McComb | E03D 11/02 4/420 |
| 305,141 | A | 9/1884 | Brandeis | |
| 310,370 | A | 1/1885 | Brady | |
| 340,287 | A | 4/1886 | Clifford | |
| 345,667 | A | 7/1886 | Buskirk | |
| 476,011 | A | 5/1892 | Hamilton | |
| 796,848 | A | 8/1905 | Leanhart | |
| 1,107,094 | A | 8/1914 | Mitchell | |
| 1,183,893 | A | 5/1916 | Mann | |
| 1,308,301 | A | 7/1919 | Sakogawa | |
| 1,928,717 | A | 10/1933 | Campus | |
| 1,529,819 | A | 8/1937 | Adams | |
| 2,153,536 | A | 4/1939 | Groeniger | |
| 2,154,240 | A | 4/1939 | Groeniger | |
| 2,164,320 | A | 7/1939 | Groeniger | |
| 3,046,569 | A | 7/1962 | Holberson | |
| 3,334,358 | A | 8/1967 | McPherson | |
| 3,538,518 | A | 11/1970 | Helke et al. | |
| 3,798,681 | A * | 3/1974 | Johansen | E03D 11/10 4/420 |
| 3,860,973 | A | 1/1975 | Uyeda et al. | |
| 4,075,718 | A | 2/1978 | Hargraves | |
| 4,145,776 | A | 3/1979 | Crosby et al. | |
| 4,155,129 | A | 5/1979 | Russell | |
| 4,158,243 | A | 6/1979 | McCann | |
| 4,217,668 | A | 8/1980 | Sargent et al. | |
| 4,246,666 | A | 1/1981 | Stansbury, Jr. | |
| 4,404,696 | A | 9/1983 | Heinze et al. | |
| 4,475,887 | A | 10/1984 | Foster et al. | |
| 4,581,779 | A | 4/1986 | Matsui et al. | |
| 4,813,085 | A | 3/1989 | Strangfeld | |
| 4,930,167 | A | 6/1990 | Ament | |
| 5,073,994 | A | 12/1991 | Sargent et al. | |
| 5,271,105 | A | 12/1993 | Tyler | |
| 5,715,544 | A | 2/1998 | Huffman et al. | |
| 5,875,499 | A | 3/1999 | Hoffman et al. | |
| 5,960,483 | A * | 10/1999 | Delzer | E03D 11/12 4/233 |
| 6,070,276 | A | 6/2000 | Yeung | |
| 6,145,138 | A | 11/2000 | Nakamura et al. | |
| 6,247,193 | B1 * | 6/2001 | Riepl | E03D 11/06 4/420 |
| 6,397,405 | B1 | 6/2002 | Grech et al. | |
| 6,415,457 | B2 | 7/2002 | Schmucki | |
| 6,986,172 | B2 | 1/2006 | Hidetaka et al. | |
| 7,263,727 | B1 | 9/2007 | Zhurin et al. | |
| 7,640,604 | B2 | 1/2010 | Cummings | |
| 7,661,153 | B2 | 2/2010 | Nakamura et al. | |
| 7,827,628 | B2 | 11/2010 | Ichiki et al. | |
| 8,151,379 | B2 | 4/2012 | Mueller et al. | |
| 8,336,128 | B2 | 12/2012 | Murphy | |
| 2003/0115664 | A1 | 6/2003 | Kosugi et al. | |
| 2003/0140406 | A1 | 7/2003 | Miwa et al. | |
| 2005/0000007 | A1 | 1/2005 | Cummings | |
| 2005/0005348 | A1 | 1/2005 | Buchanan | |
| 2005/0115042 | A1 * | 6/2005 | Davies | B28B 1/002 29/401.1 |
| 2005/0268391 | A1 | 12/2005 | Reichmuth et al. | |
| 2006/0005310 | A1 | 1/2006 | Nakamura et al. | |
| 2006/0096017 | A1 | 5/2006 | Yamasaki et al. | |
| 2006/0260033 | A1 | 11/2006 | Preston | |
| 2007/0061955 | A1 | 3/2007 | Asada et al. | |
| 2007/0277302 | A1 | 12/2007 | Ichiki et al. | |
| 2008/0271234 | A1 | 11/2008 | Okada et al. | |
| 2008/0276362 | A1 | 11/2008 | O'Malley et al. | |
| 2009/0019630 | A1 * | 1/2009 | Bernabei | B28B 1/002 4/420 |
| 2010/0125945 | A1 | 5/2010 | Hashem et al. | |
| 2010/0186158 | A1 | 7/2010 | Morita et al. | |
| 2011/0131717 | A1 * | 6/2011 | Beale | E03D 11/00 4/420 |
| 2011/0231989 | A1 | 9/2011 | O'Malley et al. | |
| 2012/0210505 | A1 | 8/2012 | Pearson | |
| 2012/0246817 | A1 | 10/2012 | O'Malley | |
| 2013/0019391 | A1 | 1/2013 | Yoneda et al. | |
| 2013/0047326 | A1 | 2/2013 | Yamasaki et al. | |
| 2013/0047328 | A1 | 2/2013 | Yamasaki et al. | |
| 2013/0047329 | A1 | 2/2013 | Yamasaki et al. | |
| 2013/0047330 | A1 | 2/2013 | Yamasaki et al. | |
| 2013/0067652 | A1 | 3/2013 | Murphy | |
| 2015/0152628 | A1 * | 6/2015 | Hirai | E03D 5/00 4/420 |

FOREIGN PATENT DOCUMENTS

| | | | |
|---|---|---|---|
| CN | 202090410 | U | 2/2011 |
| CN | 202755424 | | 2/2013 |
| CN | 102953424 | A | 3/2013 |
| DE | 9725 | | 5/1880 |
| DE | 9884 | | 6/1880 |
| DE | 25991 | | 2/1884 |
| DE | 214437 | | 10/1909 |
| DE | 596604 | | 5/1934 |
| DE | 2150451 | | 4/1973 |
| DE | 4127835 | | 12/1992 |
| EP | 0519885 | A1 | 12/1992 |
| EP | 0747545 | | 11/1996 |
| EP | 1077293 | A2 | 2/2001 |
| EP | 1795400 | A1 | 6/2007 |
| EP | 2318601 | | 5/2011 |
| EP | 2392378 | | 12/2011 |
| FR | 856962 | | 8/1940 |
| FR | 2188003 | A1 | 1/1974 |
| GB | 471058 | | 8/1937 |
| GB | 519531 | | 3/1940 |
| GB | 519533 | | 3/1940 |
| GB | 524423 | | 8/1940 |
| GB | 528110 | | 10/1940 |
| GB | 531085 | | 12/1940 |
| GB | 935949 | | 9/1963 |
| GB | 983855 | | 2/1965 |
| GB | 1036427 | | 7/1966 |
| GB | 2012835 | | 8/1979 |
| GB | 2045311 | | 10/1980 |
| GB | 2057030 | | 3/1981 |
| GB | 2203178 | | 10/1988 |
| GB | 2466763 | | 7/2010 |
| GB | 2470633 | | 12/2010 |
| JP | 2952645 | B | 9/1999 |
| JP | 2000-080711 | | 3/2000 |
| JP | 2001-271407 | | 10/2001 |
| JP | 2001-279789 | | 10/2001 |
| JP | 2001-279791 | | 10/2001 |
| JP | 2001-323541 | | 11/2001 |
| JP | 2002-106048 | | 4/2002 |
| JP | 2002-294842 | | 10/2002 |
| JP | 2003-261978 | | 9/2003 |
| JP | 2004-003384 | | 1/2004 |
| JP | 2004-011413 | | 1/2004 |
| JP | 2004-011414 | | 1/2004 |
| JP | 2004-156308 | | 6/2004 |
| JP | 2004-156309 | | 6/2004 |
| JP | 2005-098005 | | 4/2005 |
| JP | 2005-113642 | | 4/2005 |
| JP | 2005-213881 | | 8/2005 |
| JP | 2005-307622 | | 11/2005 |
| JP | 2006-230980 | | 9/2006 |
| JP | 2007-308912 | | 11/2007 |
| JP | 2007-315011 | | 12/2007 |
| JP | 2008-095436 | | 4/2008 |
| JP | 2008-138419 | | 6/2008 |
| JP | 2009-068223 | | 4/2009 |
| JP | 2009-197506 | | 9/2009 |
| JP | 2009-249819 | | 10/2009 |
| JP | 2010-031551 | | 2/2010 |
| JP | 2010-180587 | | 8/2010 |
| JP | 2010-236320 | | 10/2010 |
| JP | 2010-265693 | | 11/2010 |
| JP | 2011-208362 | | 10/2011 |
| JP | 2012-172403 | | 9/2012 |
| JP | 2012-207503 | | 10/2012 |

(56) References Cited

FOREIGN PATENT DOCUMENTS

| | | | |
|---|---|---|---|
| JP | 2012-207504 | | 10/2012 |
| JP | 2012-229569 | | 11/2012 |
| JP | 2013-044179 | | 3/2013 |
| JP | 2013-044180 | | 3/2013 |
| JP | 2013-044181 | | 3/2013 |
| JP | 2013-050027 | | 3/2013 |
| KR | 101204787 | | 11/2012 |
| WO | WO 99/29972 | | 6/1999 |
| WO | WO 01/53618 | | 7/2001 |
| WO | WO 03/014483 | A1 | 2/2003 |
| WO | WO 03/102315 | | 12/2003 |
| WO | WO 2004/082447 | | 9/2004 |
| WO | WO 2004/109022 | | 12/2004 |
| WO | WO 2006/079687 | | 8/2006 |
| WO | WO 2009/030904 | | 3/2009 |
| WO | WO 2011/004174 | | 1/2011 |
| WO | WO 2012/140607 | | 10/2012 |
| WO | WO 2012/140608 | | 10/2012 |
| WO | WO 2013/083432 | | 6/2013 |
| WO | WO 2013/087195 | | 6/2013 |

OTHER PUBLICATIONS

Partial European Search Report for EP Application No. 15159722.6 dated Jul. 17, 2015 (7 pages).

* cited by examiner

DUAL-JET TOILET

CROSS-REFERENCE TO RELATED PATENT APPLICATIONS

This application claims priority to and the benefit of U.S. Provisional Patent Application No. 61/954,907, filed on Mar. 18, 2014, the entirety of which is incorporated herein by reference.

BACKGROUND

This application relates generally to the field of toilets (e.g., water closets, flush toilets, etc.). More specifically, this application relates to an improved dual jet rimless toilet having two jets that are positioned proximate a water spot to more efficiently and effectively utilize the flush water. The toilet may have a two-piece construction, as will be described herein.

In view of a variety of factors, such as legislation regulating the amount of water a toilet may use per flush cycle and the cost and availability of municipal water, toilet manufacturers have tried to design toilets which have a more efficient flush cycle (i.e., the toilets use less water per flush cycle). As toilets use less and less water for a flush cycle, the effectiveness of the toilet to clean and evacuate a bowl of waste may be undesirably compromised.

Conventional toilets typically include a bowl which is configured to receive waste. Water is usually introduced to the bowl in order to wash the bowl and facilitate in transferring the waste therein to a drain, such as a municipal sewer drain. An upper rim may be positioned above the bowl (e.g., overhanging the bowl), and the rim may include several holes (e.g., apertures, spray holes, jets, etc.) through which flush water may flow in order to wash the bowl and transfer any waste to a drain.

One example of a conventional rim design is a box-type rim, which may have a closed, hollow cross-section through which water may flow. A box rim may be integrally formed with a toilet bowl, or formed as a separate part and attached to a top portion of the toilet bowl. Apertures may be provided along a bottom surface of the bowl rim. Another example of a conventional rim design is an open-type rim, which may have a cross-section shaped like an inverted "U." When compared to the box-type rim, the open rim does not include a bottom wall for at least part of its length. Open-type rims may be integrally formed with a toilet bowl, or cast as a separate piece and attached to the toilet bowl. An example of an open rim is disclosed, e.g., in U.S. Patent Application Publication 2013/0019391.

Toilets rims, such as the box-type rim and the open-type rim, typically overhang at least a portion of the toilet bowl (i.e., usually near an upper, outward portion of the toilet bowl). Consequently, water flowing from such a toilet rim typically enters a top portion of the toilet bowl, and has to cover most of the toilet bowl surface before reaching a water spot. Toilet bowl surfaces, while typically smooth, provide at least some resistance to water flow, which removes hydraulic energy from the flush water. Water flowing through such rim holes also loses hydraulic energy simply because such rim holes are typically positioned far away from the water spot, and water flowing through the rim holes changes direction and also becomes somewhat dispersed as it flows to the water spot. Thus, toilet designs which incorporate these types of rims may undesirably result in the flush water having a lower amount of hydraulic energy with which to use in a flush cycle.

Further, a portion of the toilet bowl which is directly underneath an overhanging rim may be concealed from view above. Accordingly, portions of a toilet bowl which are concealed from a user's view might be inadvertently neglected when the user cleans the toilet. As a result, waste and contamination (e.g., bacteria) may undesirably collect underneath and within an overhanging toilet rim. Also, waste and contamination may collect within the rim itself.

It would be advantageous to produce a toilet which is designed such that the hydraulic energy of the flush water is not reduced by flowing over a toilet bowl surface. It would also be advantageous to produce a toilet that more efficiently and effectively removes waste from a toilet bowl while using less flush water than may be conventionally used. It would be further advantageous to provide a toilet which does not collect waste underneath or within a toilet rim. Further, it would be advantageous to provide a rimless toilet that can achieve a strong flushing action in order to remove larger quantities of waste without using additional water for a flush cycle. Further, it would be advantageous to provide a toilet which is inexpensive to manufacture. Still further, it would be advantageous to provide a standard toilet which can be mounted in a variety of enclosures.

SUMMARY

According to an exemplary embodiment, a toilet includes a bowl having an opening, an outlet, and two jet holes positioned above a water line defined by a weir of a trapway. The two jet holes are configured to evacuate waste from the bowl into a drain.

According to another exemplary embodiment, a toilet includes a bowl having an upper surface, an opening, and an outlet. The toilet also includes a shroud having an upper surface and an upper cavity. The bowl is configured to be received within the upper cavity and supported on the shroud. The bowl and the shroud are cooperatively configured such that the upper surfaces of the bowl and the shroud are essentially flush when the bowl is supported on the shroud.

According to another exemplary embodiment, a toilet includes a bowl having an upper surface, an opening, and an outlet. The toilet also includes a shroud having an upper surface and an upper cavity. The bowl is configured to be received within the upper cavity and supported on the shroud. The bowl and the shroud are cooperatively configured such that the upper surfaces of the bowl and the shroud are essentially flush when the bowl is supported on the shroud.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
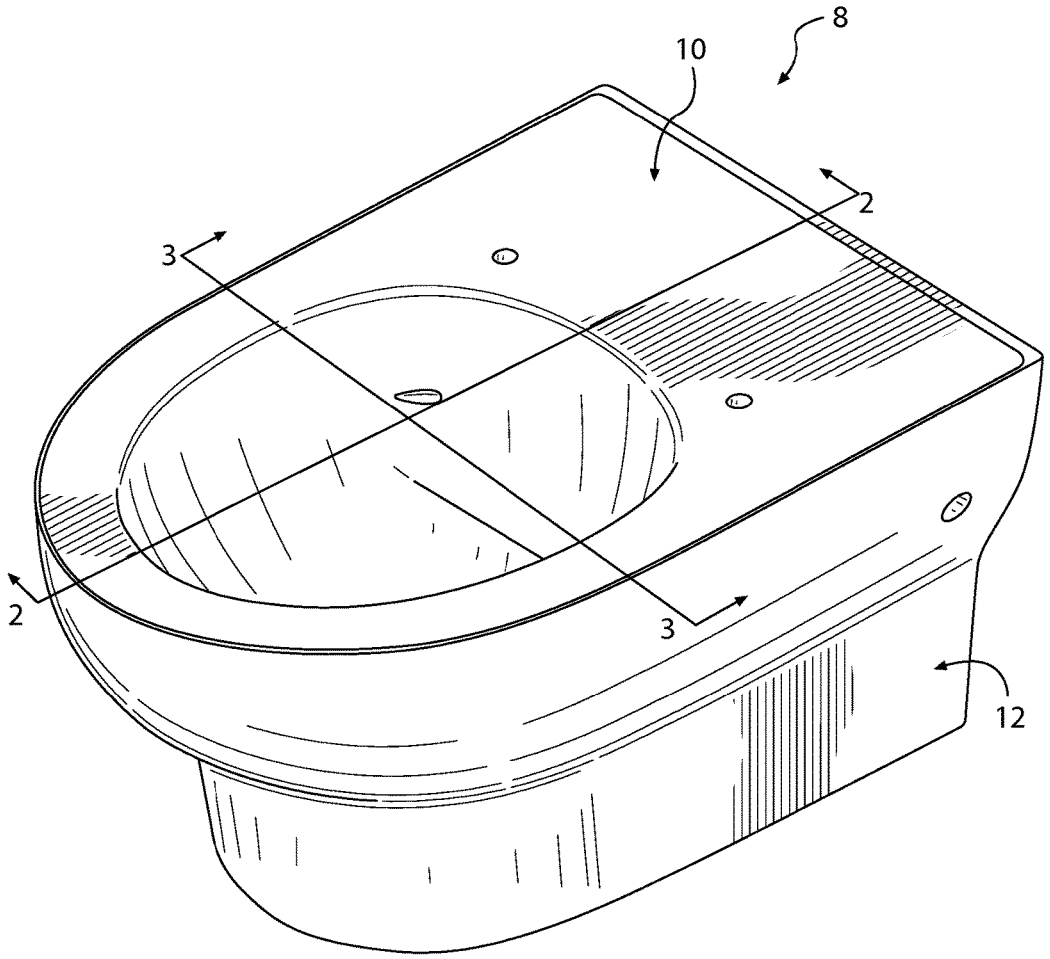
FIG. 1 illustrates a perspective view of a dual jet rimless toilet, according to an exemplary embodiment.

As discussed above, there are certain shortcomings with conventional toilets and the manner in which flush water is introduced into such toilets. As will be discussed in greater detail below, it has advantageously been discovered that a design that utilizes one or more jets positioned just above a water line of a toilet may more efficiently and effectively remove waste from a toilet bowl, thus potentially reducing the amount of flush water necessary for effective flushing. Similarly, a design that utilizes one or more jets positioned just above a water line of a toilet may be able to flush a higher quantity of bulk waste without using a higher volume of flush water. Such toilets may also optionally include a gravity sump design that is configured to provide gravity assistance to a flush so as to further enhance the flush effectiveness for a toilet. Further, as will be described in greater detail below, the height of a jet above a water spot may advantageously be tailored to affect the efficiency of a flushing cycle. For example, as the height of a jet above a water spot of a toilet is reduced, the efficiency of a flushing cycle may be improved. These and other advantages will become apparent to those reviewing the present disclosure.

According to an exemplary embodiment, a toilet assembly includes a bowl having an opening, an outlet, and at least one jet hole configured to evacuate waste from the bowl into a drain. The at least one jet hole is positioned at a height which is less than half of a distance between the opening of the bowl and a water spot defined by a weir of the trapway.

According to a particular exemplary embodiment, two jets are placed just above the waterline of the toilet and are configured to introduce flush water in a manner that is intended to more efficiently and effectively remove waste from the toilet. One advantageous feature of such a configuration is that the need for a rim that disperses water may be reduced or eliminated altogether. In other words, the location of the jets may advantageously allow for the production of a toilet with a rimless design while retaining the effectiveness of the toilet at removing waste. According to another particular exemplary embodiment, the toilet includes a gravity sump design in which the toilet includes a sump having a mouth cut-out and a lowermost point, and wherein the lowermost point is located rearward of an imaginary vertical line drawn at the point of the mouth cut-out such that gravity may assist in removing solid waste from the toilet through the outlet.

According to an exemplary embodiment, a toilet assembly includes a bowl having an upper surface, an opening, and an outlet. The toilet assembly also includes a shroud having an upper surface and a cavity. The bowl is configured to be received within the cavity and supported on the shroud, and the bowl and the shroud are cooperatively configured such that the upper surfaces of the bowl and the shroud are essentially flush when the bowl is supported on the shroud.

According to another exemplary embodiment, a toilet assembly includes a bowl having an upper surface, an opening, and an outlet. The toilet assembly also includes a shroud having an upper surface and a cavity. The bowl is configured to be received within the cavity and supported on the shroud, and the opening of the bowl does not overhang a portion of the bowl.

Figure 2:
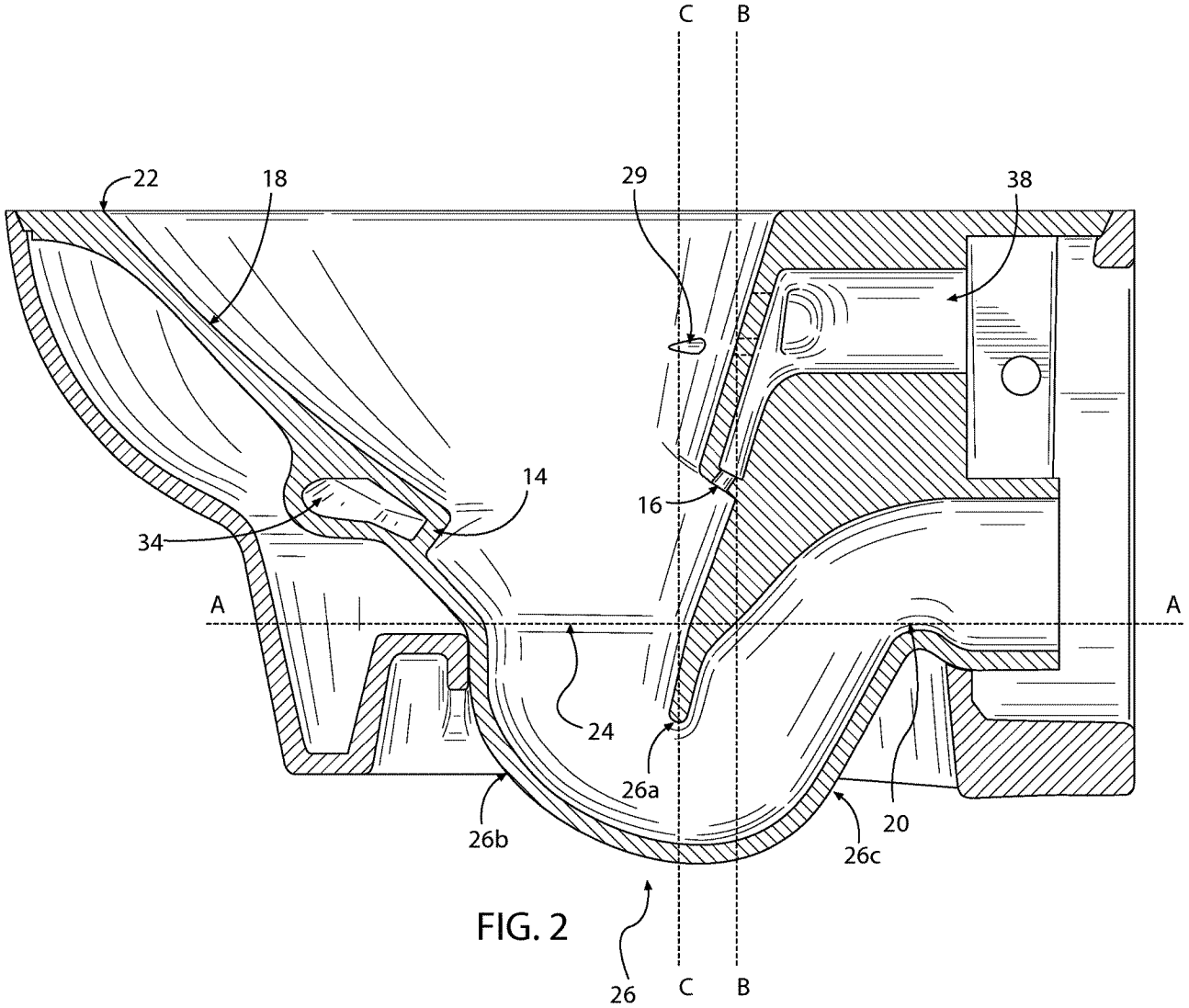
FIG. 2 is a cross-sectional view of the dual-jet rimless toilet taken along line 2-2, such as shown in FIG. 1, according to an exemplary embodiment.

According to an exemplary embodiment as shown in FIGS. 1-2, a dual jet rimless toilet design includes two jets, shown as a front hole 14 and a rear hole 16, which are positioned in relatively close proximity to a water spot (indicated in FIG. 2 by the line "A") of a toilet bowl 18 so as to more efficiently utilize the energy associated with the flush water to eliminate waste from the bowl 18. In this manner, both a front jet and a rear jet are positioned relatively near to the water spot. One advantageous consequence of such an arrangement is that the hydraulic energy of the water used to initiate a flush cycle may be preserved to a greater extent that would be the case in a more conventional rimmed toilet design (i.e., such that less energy is lost or reduced by flowing over a toilet bowl surface). In this manner, because this arrangement of jets may conserve the energy of flush water (i.e., relative to toilets in which flush water flows over a majority of a toilet bowl surface), higher energy is available for removal of bulk waste. Along the same lines, a reduced amount of flush water may be sufficient to remove bulk waste or to initiate a flush cycle.

Referring to FIG. 2, according to an exemplary embodiment, the positions and orientations of both the rear hole 16 and the front hole 14 are cooperatively configured as a "dual-jet" design. The dual-jet design of the holes 14, 16 focuses the kinetic energy of the flush water during a flush cycle to more efficiently and effectively be designed to use less water to evacuate the bowl 18 of waste or evacuate higher quantity of waste at the same flush volume (i.e., the flush cycle may evacuate a greater quantity of waste without using a greater amount of water).

According to an exemplary embodiment, the position or height of a weir 20 within a sump 26 may determine the location of a water spot in the bowl 18. For example, when water is supplied to the bowl 18 during a flushing cycle, the flush water is used to carry waste from the bowl 18, through the sump 26, over the weir 20, and into a drain (not shown, but, e.g., a municipal sewer drain). After waste is transferred into a drain, excess water from the flushing cycle remains within the trapway and the bowl 18 at a height of the water spot, thereby defining the height of a water spot and blocking sewer gases from escaping into the bowl 18.

According to an exemplary embodiment, a vertical distance (i.e., a height) between the holes 14, 16 and the water line (indicated in FIG. 2 as the line "A," which is determined or created by the weir 20), is relatively small compared to other toilets known in the art. For example, according to an exemplary embodiment, a vertical distance (i.e., a height) between the holes 14, 16 and the water line is less than 50% of a vertical distance between the water line and an opening 22 of the bowl 18 (i.e., corresponding to an overall depth of the bowl 18). According to another exemplary embodiment, a vertical distance between the holes 14, 16 and the water line is less than approximately 33% of a vertical distance between the water line and the opening 22. More particular still, according to another exemplary embodiment, a vertical distance between the holes 14, 16 and the water line is less than approximately 20% of a vertical distance between the water line and the opening 22. More particular still, according to another exemplary embodiment, the position of the holes 14, 16 may be configured to be just above (i.e., approximately 1-2 inches) the water line created by the weir 20. According to an exemplary embodiment, the holes 14, 16 may be positioned approximately between 25 mm to 75 mm above the water line. It should be understood that the holes 14, 16 may be positioned at any suitable height above the water line, and that the heights of the holes 14, 16 disclosed herein are not limiting.

With further reference to FIG. 2, the sump 26 is shown as a wash-down type trapway (i.e., a trapway in which a sufficient amount of water is used to carry waste over a weir 20 and provide a water seal to block sewer gases from escaping into the bowl). Although the sump 26 is shown as being a wash-down type trapway, it should be understood that the bowl member 10 may be provided instead with a siphonic trapway (i.e., a trapway configured to generate a siphon during a flush cycle in order to pull waste therethrough), according to another exemplary embodiment, and that the trapways disclosed herein are not limiting.

Referring still to FIG. 2, the holes 14, 16 are configured to direct (i.e., project, spout, etc.) flush water toward a central portion of an outlet hole 24 of a sump 26 (i.e., a trap, trapway, etc.), such that the flush water does not lose velocity by colliding and flowing over a portion of the bowl 18. Thereby, the force of the flush water used to evacuate the bowl 18 may be maximized.

Also, according to an exemplary embodiment, the toilet includes a gravity sump design that is configured to more effectively and efficiently remove solid waste from the bowl by utilizing gravity to assist in the removal process. To this end, the bowl 18 includes a sump 26 having a mouth cut-out portion 26*a* (i.e., shown in FIG. 2 as a downwardly protruding member positioned such that it extends into the sump of the toilet), a front portion 26*b* of the sump 26, and a rear portion 26*c* of the sump 26. The front portion 26*b* of the sump has a downwardly sloping profile and the rear portion 26*c* has an upwardly sloping profile. The lowermost point of the sump 26 (i.e., the point where the downwardly sloping front portion of the sump transitions to the upwardly sloping rear portion of the sump) is located behind or rearward of the mouth cut-out 26*a*, such that the mouth cut-out 26*a* does not extend downward at the same location of the lowermost point of the sump 26. Stated another way, if an imaginary vertical line (e.g., the line "C" shown in FIG. 2) were drawn at the point where the mouth cut-out 26*a* is positioned and another imaginary vertical line (e.g., the line "B" shown in FIG. 2) were drawn to intersect the lowermost point of the sump 26, the line for the lowermost point of the sump 26 would be located behind or rearward of the line associated with the mouth cut-out 26*a*. One advantageous feature of such a configuration is that it allows gravity to more effectively assist the removal of bulk waste from the bowl 18. Such a feature may be referred to in the present application as a "gravity sump" configuration.

The combination of the position of the jets 14, 16 just above the waterline and the gravity sump configuration may allow one to produce a toilet that more effectively and efficiently removes waste from a bowl, which may allow for other design modifications. One such modification is the elimination of a water-dispersing rim at the upper part of the toilet. While the present application is described in the context of a particular rimless toilet design as shown and described in the figures, it should be understood that the jets and gravity sump configurations may be used in other toilet designs as well, and that the embodiment shown and described herein should not be interpreted as limiting.

Figure 8:
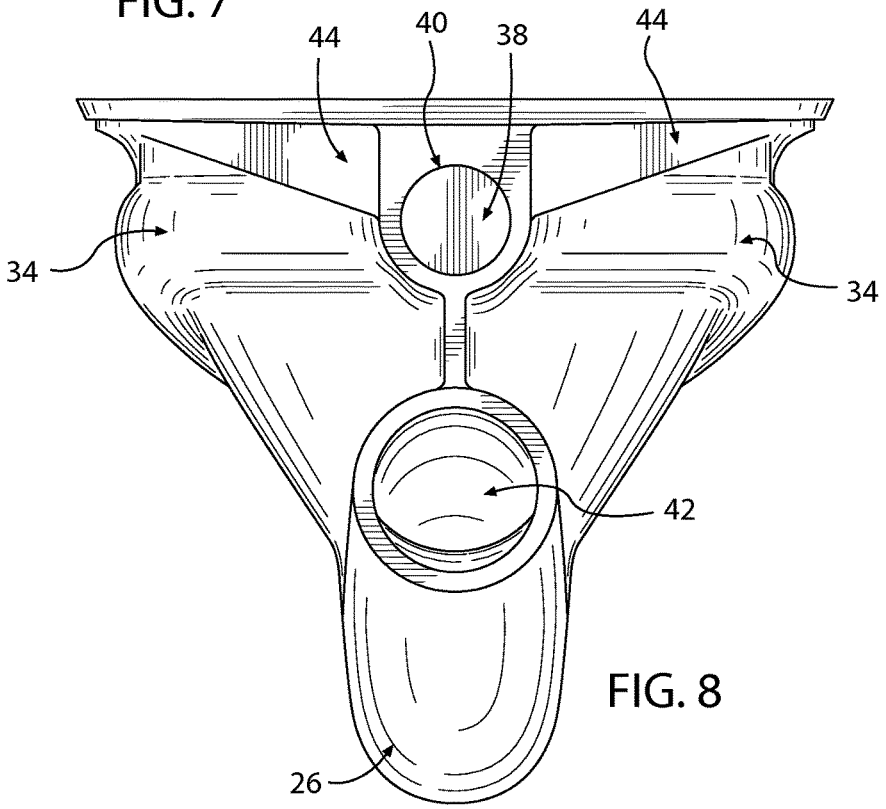
FIG. 8 is a bottom plan view of the dual jet rimless toilet bowl shown in FIG. 5.
Figure 9:
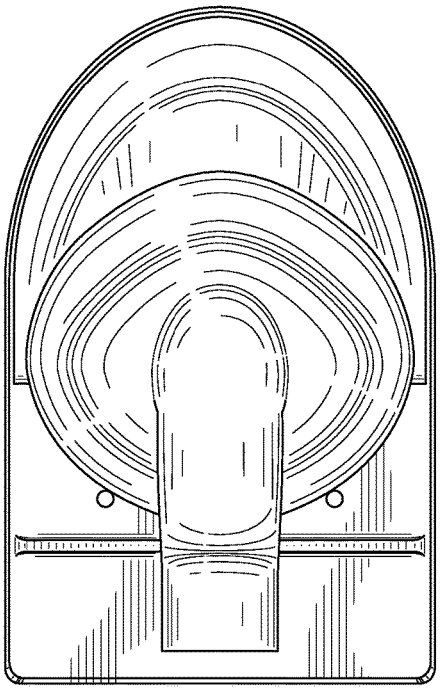
FIG. 9 is a bottom plan view of the dual jet rimless toilet bowl shown in FIG. 5.

Referring to FIG. 2 and FIG. 8, an inlet channel 38 is shown as extending horizontally from a rear side of the bowl member 10 to the bowl 18. As shown, the rear hole 16 and multiple channels 34 may be fluidly coupled to the inlet channel 38. Further, the front hole 14 and a pair of side holes 29 may be fluidly coupled to the inlet channel 38. Referring briefly to FIG. 8, according to an exemplary embodiment, an inlet channel 38 is defined by an inlet hole 40, which is provided on a rear end of the bowl member 10. The inlet hole 40 may be configured to couple to a flush valve (not shown, but, e.g., a flush valve which is coupled to a water supply, such as a water tank, an in-wall cistern, or a pressurized water supply, in order to supply water to the bowl 18).

Referring to FIG. 2, according to an exemplary embodiment, the front hole 14 is centrally disposed between a left and right side of the bowl 18, within a front side of the bowl 18. The front hole 14 may be in fluid communication with the inlet channel 38 and a plurality of water channels 34. According to an exemplary embodiment, the front hole 14 is configured such that water flowing therethrough is projected (e.g., directed, dispersed, sprayed, etc.) in a downward direction toward the outlet hole 24 and the sump 26. Further, the shape, position, and orientation of the front hole 14 may be configured to facilitate a flushing action, thereby transferring waste from the bowl 18 to a drain (not shown) and the sump 26. For example, the front hole 14 may be round, oblong, oval, or have any other suitable shape, and the shapes of the front hole 14 disclosed herein are not limiting. According to an exemplary embodiment, the rear hole 16 and the front hole 14 may be cooperatively configured to facilitate a flushing action of water and waste through the outlet hole 24 and the sump 26.

Figure 3:
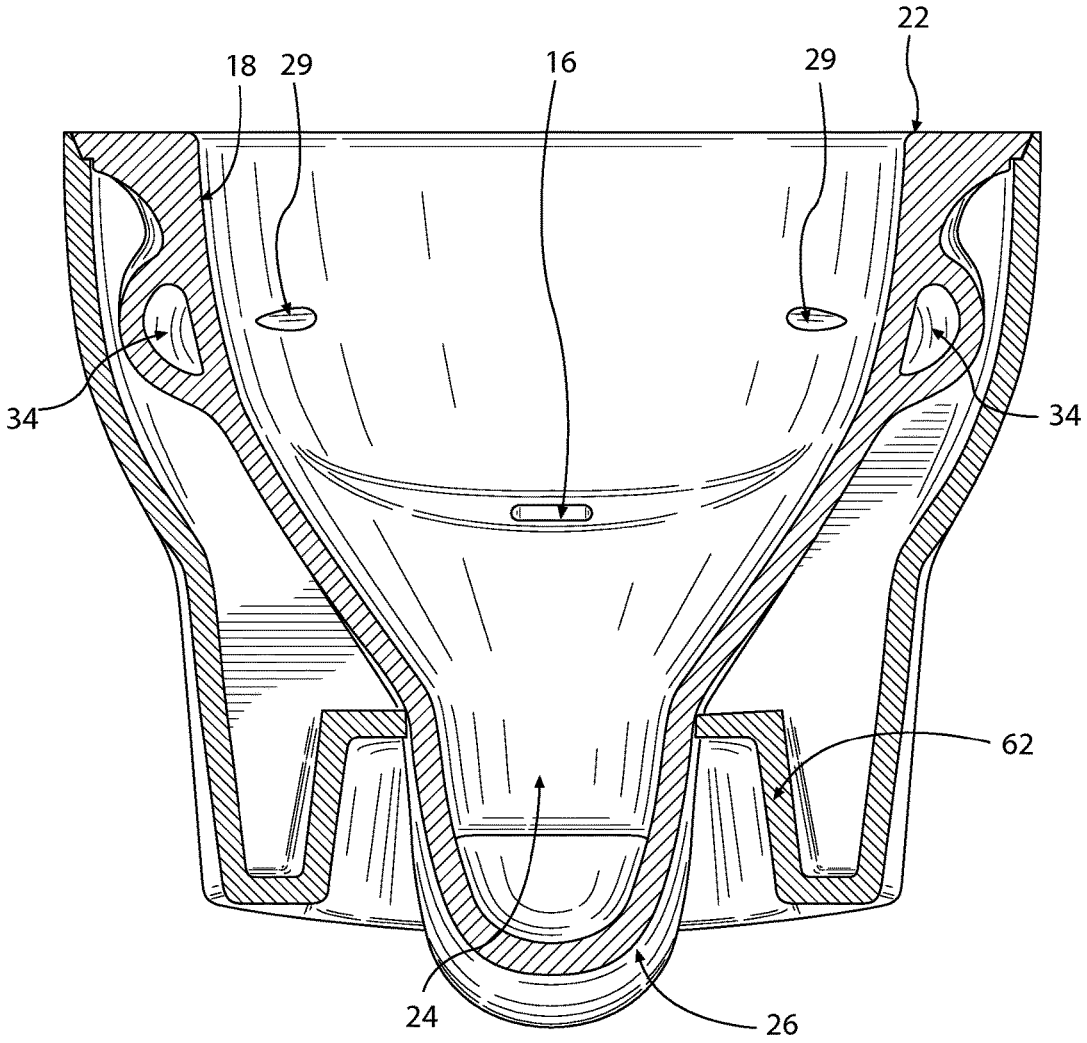
FIG. 3 is a cross-sectional view of the dual-jet rimless toilet taken along line 3-3, such as shown in FIG. 1, according to an exemplary embodiment.

Referring now to FIG. 3, according to an exemplary embodiment, the rear hole 16 is centrally disposed between a left and right side of the bowl 18, within a rear side of the bowl 18. The rear hole 16 may be in fluid communication with the inlet channel 38 (not shown in FIG. 3, but see, e.g., the cross-sectional view in FIG. 2). As shown in FIG. 3, the rear hole 16 is slot-shaped (i.e., shaped like a slot), such that a horizontal dimension of the rear hole 16 is larger than a vertical dimension. According to other exemplary embodiments, the rear hole may have any suitable shape (e.g., round, oblong, oval, etc.) to optimize (i.e., increase the velocity) the flow of water therethrough. According to an exemplary embodiment, the rear hole 16 is configured such that water flowing therethrough is projected (e.g., directed, dispersed, sprayed, etc.) in a downward direction toward the outlet hole 24 and the sump 26. Further, the position and orientation of the rear hole 16 may be configured to facilitate a flushing action, thereby transferring waste from the bowl 18 to a drain (not shown) and the sump 26.

Although particular exemplary embodiments for the front and rear jet holes 14, 16 have been described herein and illustrated in the figures, a toilet may include greater or fewer jet holes, according to other exemplary embodiments. Further, the position of the jet holes may be in any suitable position, according to other exemplary embodiments. For example, the jet holes may be arranged, for example, on a front, rear, left, or right side of the bowl 18, according to other exemplary embodiments. According to an exemplary embodiment, multiple jet holes may be positioned relative to a water spot at different heights, or the same height. The front hole 14 and the rear hole 16 may have any suitable shape. For example, the shape of the holes 14, 16 may be substantially round (i.e., circular), oval-shaped, or slot-shaped. Further, it should be understood that the exemplary embodiments disclosed herein are not limiting.

According to an exemplary embodiment, the holes 14, 16 at the rear and front of the toilet bowl 18 may obviate the need for a rim that carries water to various holes/jets. Therefore, the holes 14, 16 may potentially allow one to produce a rimless bowl design that is easier and less costly to manufacture, since the rim is no longer required to direct water.

Referring to FIGS. 1-4, according to an exemplary embodiment, a rimless toilet assembly 8 is disclosed. One advantageous consequence of a toilet having a dual-jet design, as described above, is that the toilet may be produced as having a rimless design (i.e., the rim may no longer be required to distribute or direct water to a toilet bowl). As utilized herein, the term "rimless" is intended to mean a toilet which does not include an upper rim (i.e., a rim which is either integrally formed with a toilet bowl or fixedly coupled to a toilet bowl) which overhangs an opening of a toilet bowl, or which extends inwardly into a toilet bowl proximate the opening.

For example, according to an exemplary embodiment, a bowl 18 of a bowl member 10 may be substantially outwardly concave from an opening 22 of the bowl 18 down to an outlet hole 24 (not shown in FIG. 1, but see, e.g., FIG. 2). According to another exemplary embodiment, the bowl 18 may include one or more points of inflection where an outwardly concave surface transitions to an outwardly convex surface, or an outwardly convex surface transitions to an outwardly concave surface. In each exemplary embodiment, a rim does not overhang the opening 22. Advantageously, because a rim does not overhang the opening 22, every portion of the bowl 18 may be viewed from above, such that any contamination which might be present in the bowl 18 is not hidden from view and a user may easily clean the entire surface of the bowl 18. Of course, according to other exemplary embodiments, the toilet may include a rim, and the other features described herein (e.g., the location of the jet holes just above the waterline of the bowl, the gravity sump design) may be used either with or without a rimless design, and either with or without the two-piece assembly that will be discussed below according to one particular exemplary embodiment. It should be noted that any of the features discussed herein may be used with toilets having other configurations, and that all such modifications are intended to be encompassed by the present disclosure.

Further according to another aspect of the exemplary embodiments discussed herein, and referring generally to the FIGURES, the rimless toilet assembly may be provided as a two-piece assembly, in which a bowl member constitutes the first piece of the toilet assembly and is configured to be received within, and supported by, an outer shroud, which is the second piece of the toilet assembly.

Referring to FIGS. 1-4, according to an exemplary embodiment, the rimless toilet assembly 8 includes an inner bowl member 10 and an outer shroud 12 (e.g., a casing, shell, enclosure, etc.). As shown in FIG. 1, according to an exemplary embodiment, the toilet assembly 8 is configured to be a wall-hung toilet (i.e., a rear side of the toilet assembly 8 is configured to be mounted to a wall, as will be explained below). According to another exemplary embodiment, a toilet assembly may be configured to be a floor-mounted toilet.

Further referring to FIGS. 1-4, according to an exemplary embodiment, the bowl member 10 is configured to be received within, and supported by, the shroud 12. According to an exemplary embodiment, the shroud 12 is configured to enclose or envelop the bowl member 10. According to various exemplary embodiments, the shroud 12 and the bowl member 10 may be formed from vitreous china, porcelain, stainless steel, or any other suitable material, and it should be understood that the materials disclosed herein are not limiting.

According to an exemplary embodiment, the bowl member 10 and the shroud 12 are provided with contact surfaces (e.g., mating surfaces) which are cooperatively configured so that when the bowl member 10 is supported by the shroud 12, a top surface of the bowl member 10 is essentially flush with a top surface of the shroud 12. For example, an outer periphery of the bowl member 10 may be configured to pair (i.e., correspond to, match, etc.) with an outer periphery of the shroud 12, such that when the outer periphery of the bowl member 10 rests upon the outer periphery of the shroud 12, a top surface of the bowl member 10 is essentially flush with a top surface of the shroud 12 and form an integral assembly.

Figure 4:
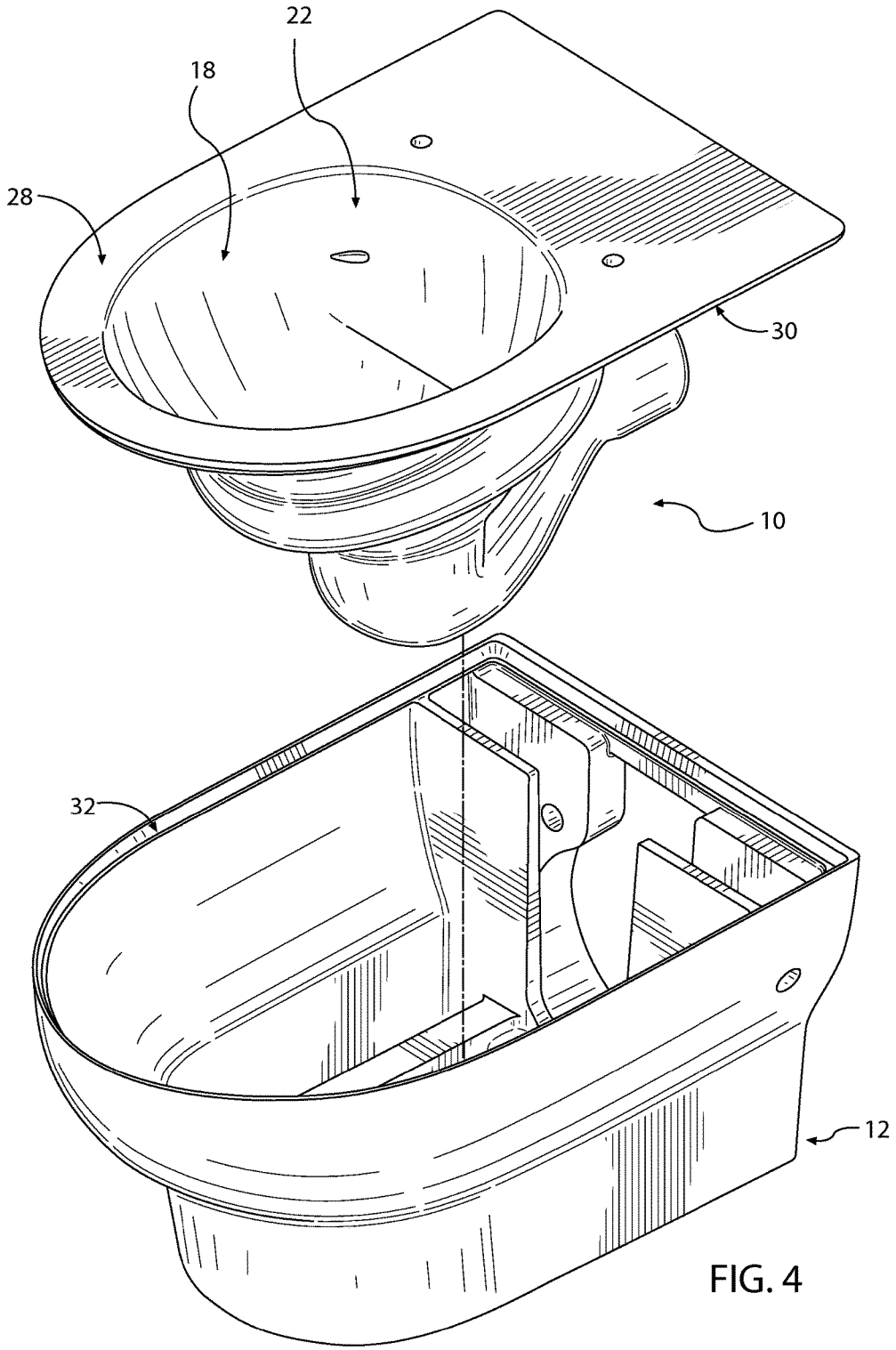
FIG. 4 is an exploded view of a dual jet rimless toilet, such as that shown in FIG. 1.
Figure 5:
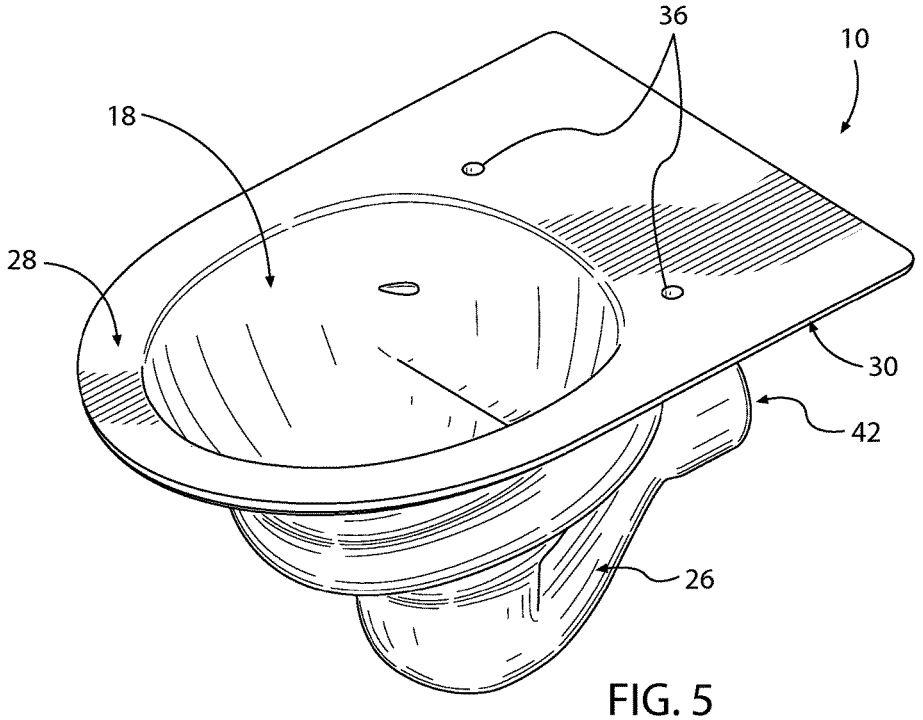
FIG. 5 illustrates a perspective view of a dual jet rimless toilet bowl, according to an exemplary embodiment.

As shown in FIG. 4, the bowl member 10 may include a top wall 28 that extends outwardly from the opening 22 of the bowl 18. According to an exemplary embodiment, a periphery of the top wall 28 includes a bowl contact surface 30 (e.g., a mating surface) provided at an angle relative to the top wall 28, such that the bowl contact surface 30 is angled inwards downwardly toward a bottom of the bowl 18. The bowl contact surface 30 is configured to rest upon a corresponding shroud contact surface 32 (e.g., a mating surface) of the outer shroud 12. As shown, the shroud contact surface 32 may be angled inwards downwardly relative to the outer shroud, such that the contact surfaces 30, 32 are cooperatively configured to be coupled together. According to another exemplary embodiment, a bowl contact surface is perpendicular to a top wall of the bowl member, and a shroud contact surface is a ledge (e.g., a shelf, flange, rabbet, wall, etc.) formed within an outer shroud. While various contact surfaces are disclosed for a bowl member and an outer shroud, it should be understood that the contact surfaces of the bowl member and the outer shroud may be configured in any suitable way, according to other exemplary embodiments, and that the exemplary embodiments disclosed herein are not limiting.

According to an exemplary embodiment, the bowl member 10 and the shroud 12 may be coupled together in various ways in order to form the toilet assembly 8. For example, mechanical fasteners or an adhesive may be used to couple the bowl member 10 to the shroud 12. Alternatively, the bowl member 10 may be coupled to the shroud 12 in any suitable way, and the methods disclosed herein are not limiting.

Referring generally to FIGS. 5-11, the bowl member 10 is shown and will be described in more detail below. According to an exemplary embodiment, the rimless bowl member 10 may be cast as a single part. Because the bowl 18 does not include a rim overhanging an upper portion of the bowl 18, the casting process of the bowl member 10 may be simplified. For example, the number of molds and/or dies used to cast the bowl member 10 may be reduced.

Figure 6:
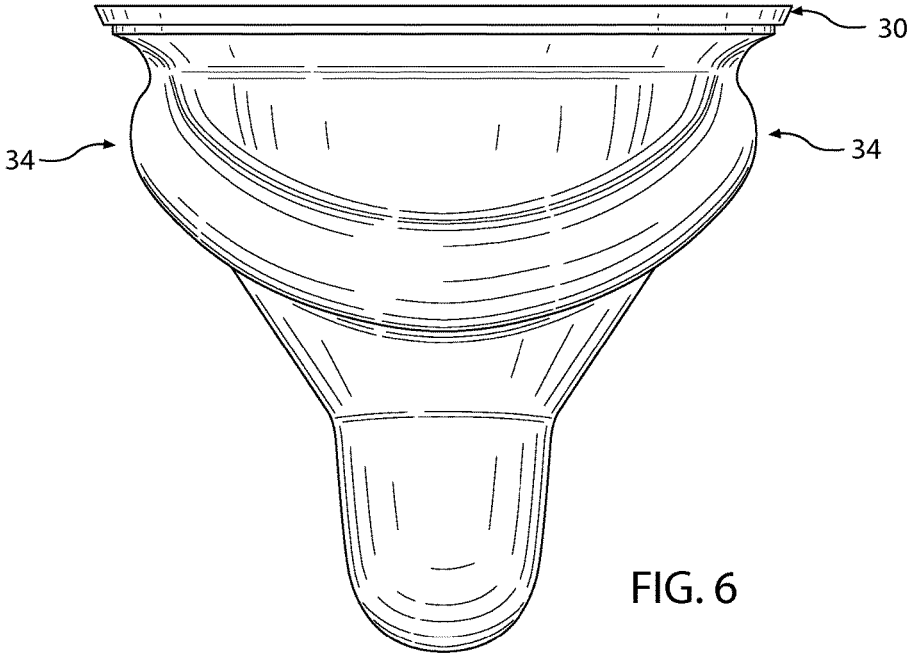
FIG. 6 is a front plan view of the dual-jet rimless toilet bowl shown in FIG. 5.

Referring to FIG. 6, according to an exemplary embodiment, the contact surface 30 of the bowl member 10 is clearly shown. Also, a duality of water channels 34 are shown surrounding the bowl 18 (i.e., on a left and right side of the bowl 18). According to an exemplary embodiment, the water channels 34 extend downwardly from a rear portion of the bowl member 10 (see also, e.g., FIGS. 8 and 10-11) to a front portion of the bowl member 10. According to another exemplary embodiment, only a single water channel 34 may be provided on the bowl member 10, the single water channel extending along either a left or right side of the bowl member 10.

Figure 7:
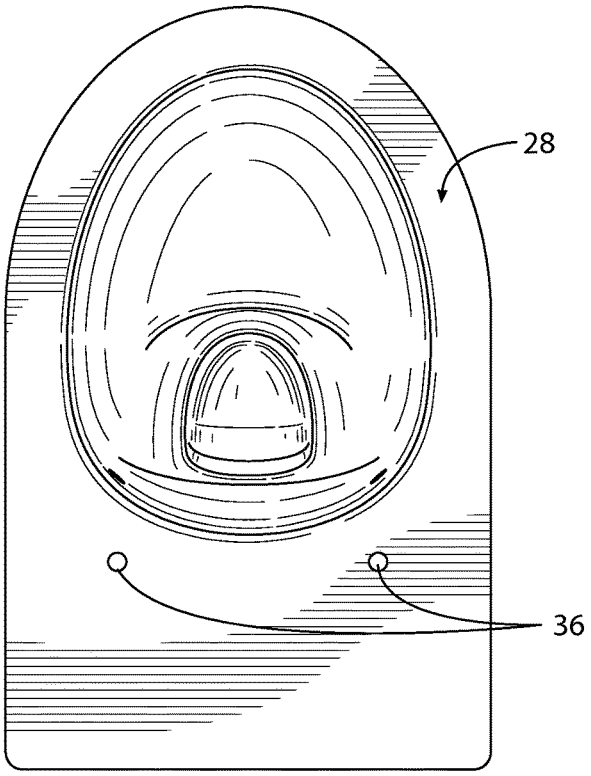
FIG. 7 is a top plan view of the dual-jet rimless toilet bowl shown in FIG. 5.

Referring to FIG. 7, a plurality of mounting holes 36 are provided within the top wall 28, behind the bowl 18. The mounting holes 36 may be used to couple a toilet attachment (not shown, but e.g., a toilet seat, toilet lid, bidet attachment, etc.) to the bowl member 10. The various toilet attachments that may be used with the bowl member 10 may pivot between closed and open positions. Such toilet attachments may rest upon the top wall 28 when the toilet attachments are in a closed position.

Referring to FIG. 8, according to an exemplary embodiment, the sump 26 is provided on a bottom end of the bowl member 10. A rear side of the sump 26 includes an outlet hole 42, which is provided below the inlet hole 40, and an outlet hole 24 (not shown in FIG. 8, but see, e.g., FIG. 2), which is provided within the bowl 18.

Figure 10:
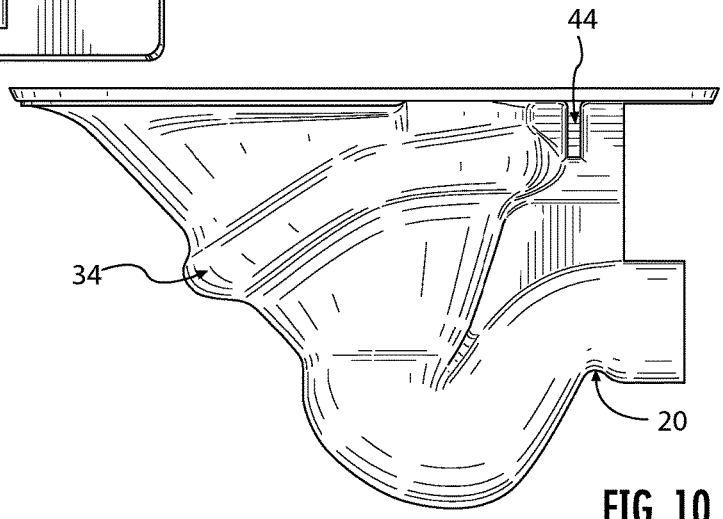
FIG. 10 is a left plan view of the dual-jet rimless toilet bowl shown in FIG. 5.
Figure 11:
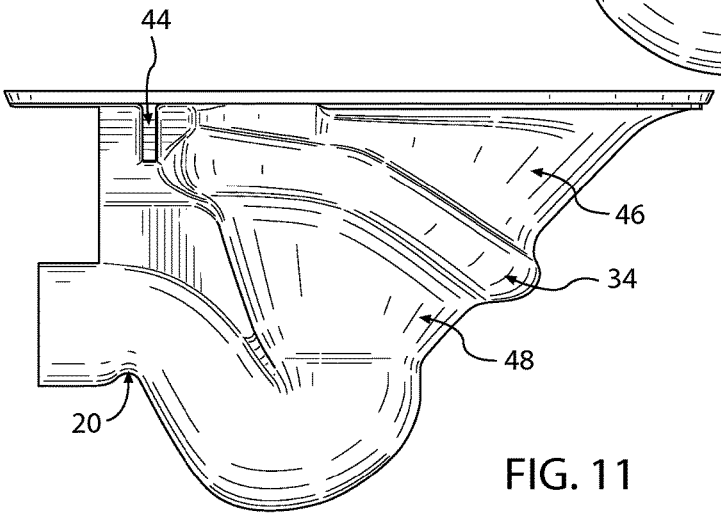
FIG. 11 is a right plan view of the dual-jet rimless toilet bowl shown in FIG. 5.

Referring to FIGS. 8 and 10-11, a vertical wall 44 is provided on either side of the inlet hole 40. The walls 44 may be used to position the bowl member 10 within the outer shroud 12. The walls 44 may also be used to support the inlet channel.

Referring to FIGS. 10-11, the bowl 18 may be defined by two halves, an upper half 46 and a lower half 48. The upper half 46 is provided above a front hole 14 (not shown in FIGS. 10-11, but see, e.g., the cross-sectional view in FIG. 2) which is defined by the channels 34, and the lower half 48 is provided below the front hole 14.

Referring generally to FIGS. 12-18, the outer shroud 12 is shown and will be described in more detail below. Although a particular shape for an outer shroud 12 is shown in the Figures, according to an exemplary embodiment, the outer shroud 12 may be configured to have any other suitable shape. For example, it is envisioned, according to an exemplary embodiment, that a particular bowl member 10 (i.e., a standard bowl member) may be configured to be interchangeable with a variety of outer shrouds, each outer shroud having a different shape or style, according to the particular toilet styles that may be in demand at any given time. Accordingly, a design for a new toilet assembly may only require designing a new outer shroud, which may be designed to couple to the standard bowl member 10. Thereby, when compared to unitary toilets which are integrally formed and designed having particular interior characteristics relating to the bowl, as well as exterior characteristics, the costs to design and produce a two-part toilet assembly 8 may be comparatively less. For example, such a two-part toilet assembly may lead to overall cost savings because the bowl member could be used across multiple product lines which would lead to cost savings on bowl molds, engineering costs, etc.

According to an exemplary embodiment, the two-piece toilet assembly 8 (see, e.g., FIG. 4) may provide several manufacturing benefits over unitary toilets, only some of which are described in detail herein. For example, various toilets, each having a unique design, may comprise a standard bowl member 10, and a unique (i.e., different, individual, customized, etc.) outer shroud 12. Because the bowl member 10 may be a standard part, which is configured to be used (i.e., such that the bowl member is common, shared, etc.) among a variety of outer shrouds, a company may realize an initial tooling cost required to manufacture the bowl member 10. Once the tooling required to manufacture the bowl member 10 has been developed, the tooling costs required for a new toilet design may be limited to the tooling costs for a particular outer shroud. The tooling required to manufacture an outer shroud may be significantly less complicated and less expensive to produce than the tooling used to produce a unitary toilet which is integrally formed and designed having particular interior and exterior characteristics. Accordingly, a two-piece toilet assembly 8 may save a company significant tooling costs related to manufacturing a new toilet design.

Further, according to an exemplary embodiment, the research and development (R&D) costs to design a new two-piece toilet assembly 8 may be comparatively less than those associated with designing a new unitary toilet. Typically, testing and validation is required to ensure that a new toilet design functions properly (e.g., that a flush cycle adequately cleans and evacuates a toilet bowl, etc.) and that a new toilet design is compliant with various governmental regulations (e.g., those relating to the consumption of water per flush). The costs of testing and validating a new toilet design may include, for example, costs to develop prototypes and costs of labor and equipment required to conduct tests. Durability tests may be required in which a new toilet design undergoes thousands of flush cycles in order to validate the toilet over its useful life. Thermal tests may be required to ensure a new toilet design can withstand a range of hot and cold temperatures. Overall, the costs to develop, test, and validate a new toilet design may be substantial, and a new unitary toilet design will typically bear at least some of these costs.

Advantageously, according to an exemplary embodiment, the R&D costs related to testing and validating the operation of a new two-piece toilet assembly may be limited to the initial R&D costs associated with testing and validating the standard bowl member 10. After the testing and validation of the bowl member 10 is complete, a new toilet may be designed by simply developing a new outer shroud which is configured to receive and support the bowl member 10, which is already pre-tested and pre-validated. Thus, the costs required to design a two-part toilet assembly may be comparatively less than the costs required to design a unitary toilet.

Only some of the benefits related to the cost savings associated with manufacturing and designing the toilet assembly 8 have been described in detail herein. Additional benefits and advantages of the toilet assembly 8 will be appreciated by those skilled in the art, and those benefits disclosed herein are not limiting.

Figure 12:
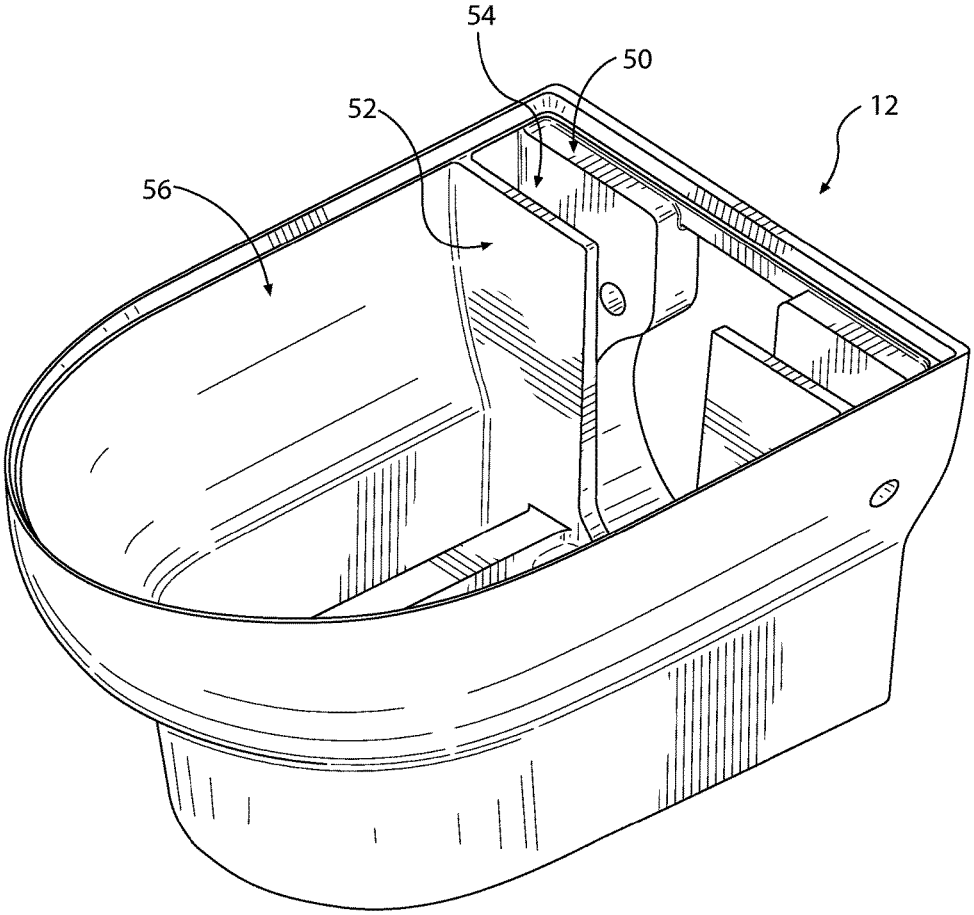
FIG. 12 is a perspective view of an outer shroud for a toilet bowl, according to an exemplary embodiment.
Figure 13:
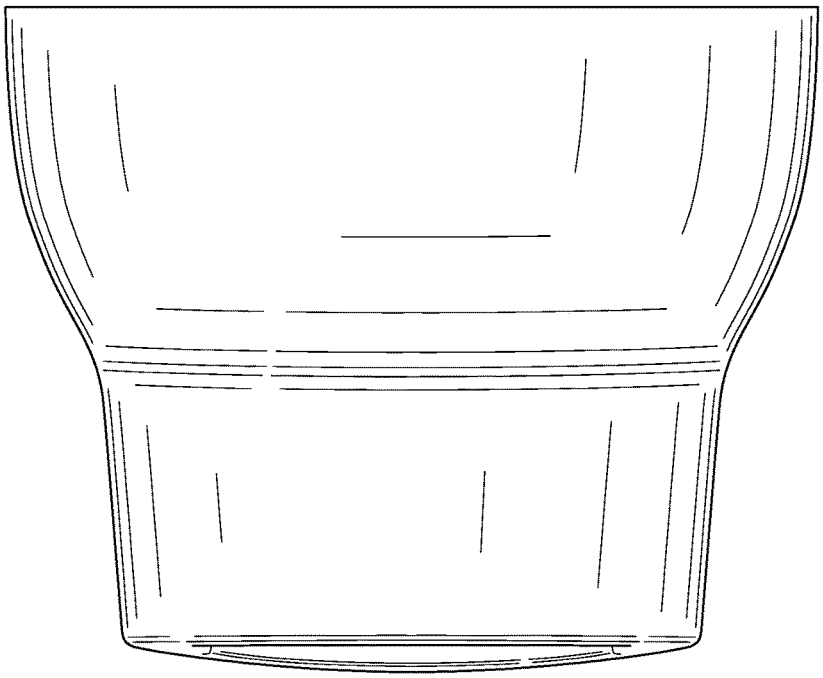
FIG. 13 is a front plan view of the outer shroud shown in FIG. 12.

Referring now to FIG. 12, the outer shroud 12 includes a rear wall 50 and a partition 52. The rear wall 50 is configured to mount (e.g., couple, attach, connect, etc.) to a wall, as will be explained below in greater detail. Together, the rear wall 50 and the partition 52 define a mounting cavity 54 provided therebetween. The mounting cavity 54 may receive the walls 44 of the bowl member 10 when the bowl member is received by the shroud 12. The partition 52 separates a central cavity 56 of the shroud 12 from the mounting cavity 54 and the rear wall 50.

Figure 14:
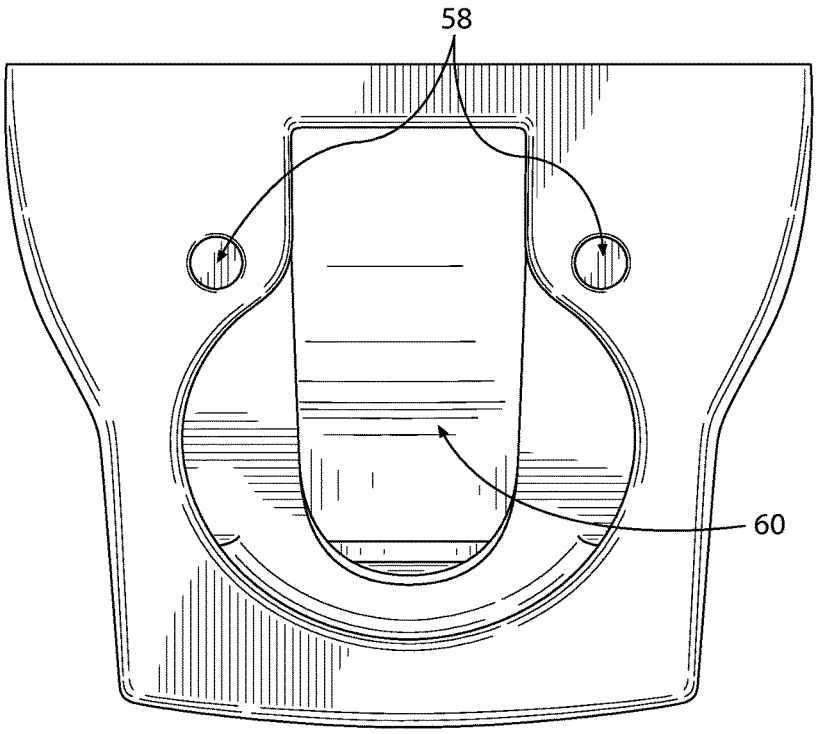
FIG. 14 is a rear plan view of the outer shroud shown in FIG. 12.

Referring now to FIG. 14, according to an exemplary embodiment, a rear side of the outer shroud 12 includes a plurality of mounting holes 58. A plurality of fasteners (not shown, but e.g., bolts, studs, etc.) may be used to couple the shroud 12 to a wall. A rear cavity 60 is also disposed within the rear wall 50. The rear cavity 60 is configured to receive the sump 26 when the bowl member 10 is received within the shroud 12.

Figure 15:
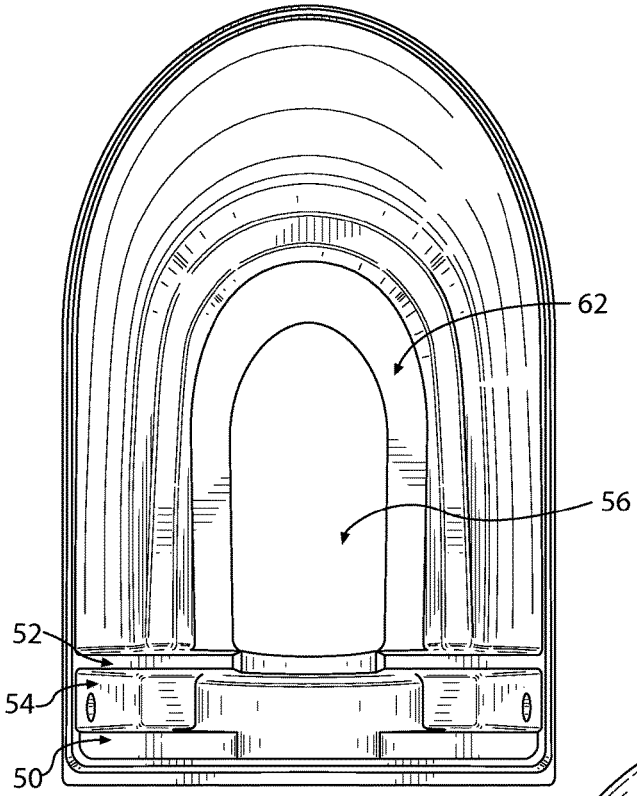
FIG. 15 is a top plan view of the outer shroud shown in FIG. 12.
Figure 16:
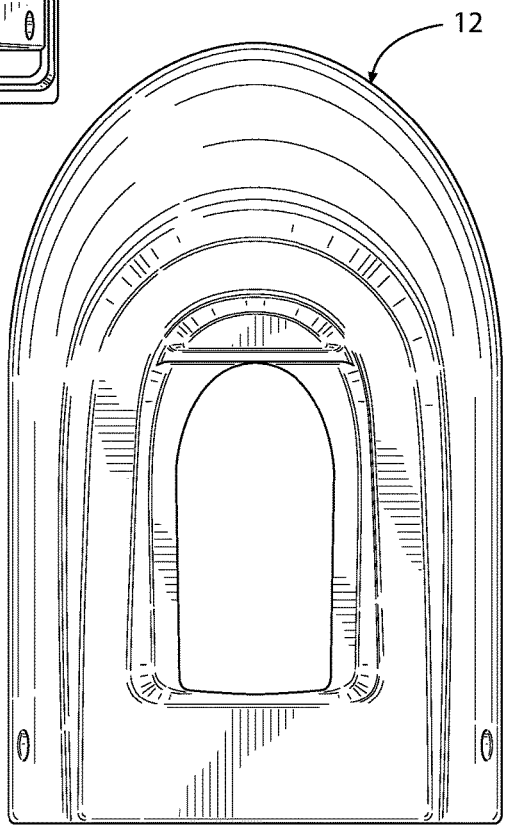
FIG. 16 is a bottom plan view of the outer shroud shown in FIG. 12.

Referring now to FIG. 15, according to an exemplary embodiment, a ledge 62 is provided within the central cavity of the shroud 12. According to an exemplary embodiment, the ledge 62 and the bowl 18 may be cooperatively configured such that the lower half 48 of the bowl 18 is supported by (i.e., rests upon) the ledge 62 when the bowl member 10 is received within the shroud 12. As shown in FIG. 15, the ledge 62 extends inwardly from a bottom of the shroud 12. In particular, according to an exemplary embodiment, the ledge 62 is provided on a front and left/right sides of the shroud 12, while the rear side of the shroud 12 is left open so as to accommodate the sump 26 of the bowl member 10 (not shown in FIG. 15, but see, e.g., FIGS. 2 and 4). Referring back to FIGS. 2-3, according to an exemplary embodiment, the bowl member 10 is supported proximate outlet hole 24 by the ledge 62.

Figure 17:
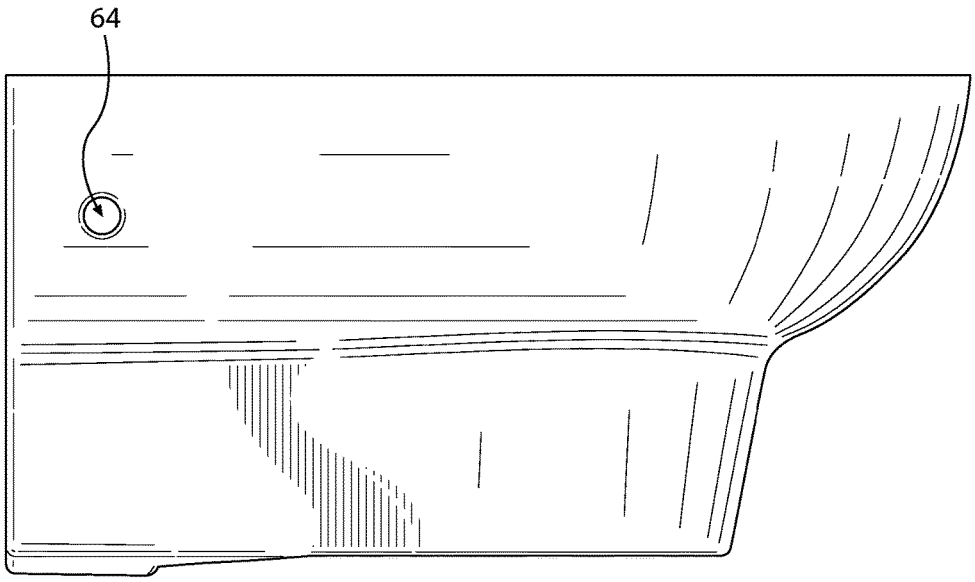
FIG. 17 is a left plan view of the outer shroud shown in FIG. 12.
Figure 18:
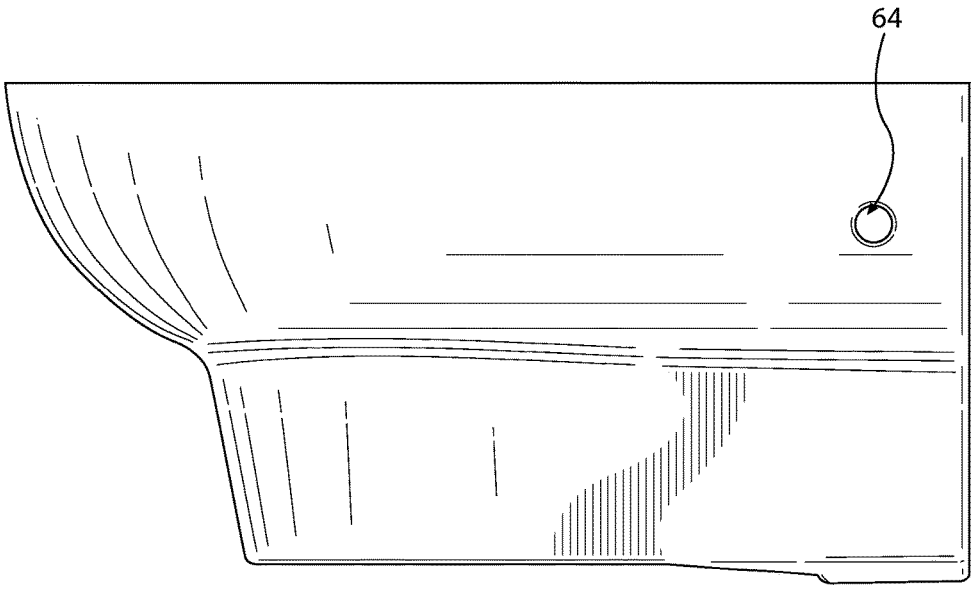
FIG. 18 is a right plan view of the outer shroud shown in FIG. 12.

Referring to FIGS. 17-18, according to an exemplary embodiment, an access hole 64 is disposed within a left and right side of the shroud 12. A rear side of the access holes 64 is defined by the rear cavity 60. From outside the shroud 12, the access holes 64 may be used to provide access to fasteners (not shown, but e.g., nuts threaded onto bolts or studs) within the rear cavity 60, which are used to secure the toilet assembly 8 to a wall. As shown, the access holes 64 are not covered; however, a cover may be used to conceal the fasteners within the rear cavity 60, or to provide the shroud 12 with a more aesthetic appearance.

Figure 19:
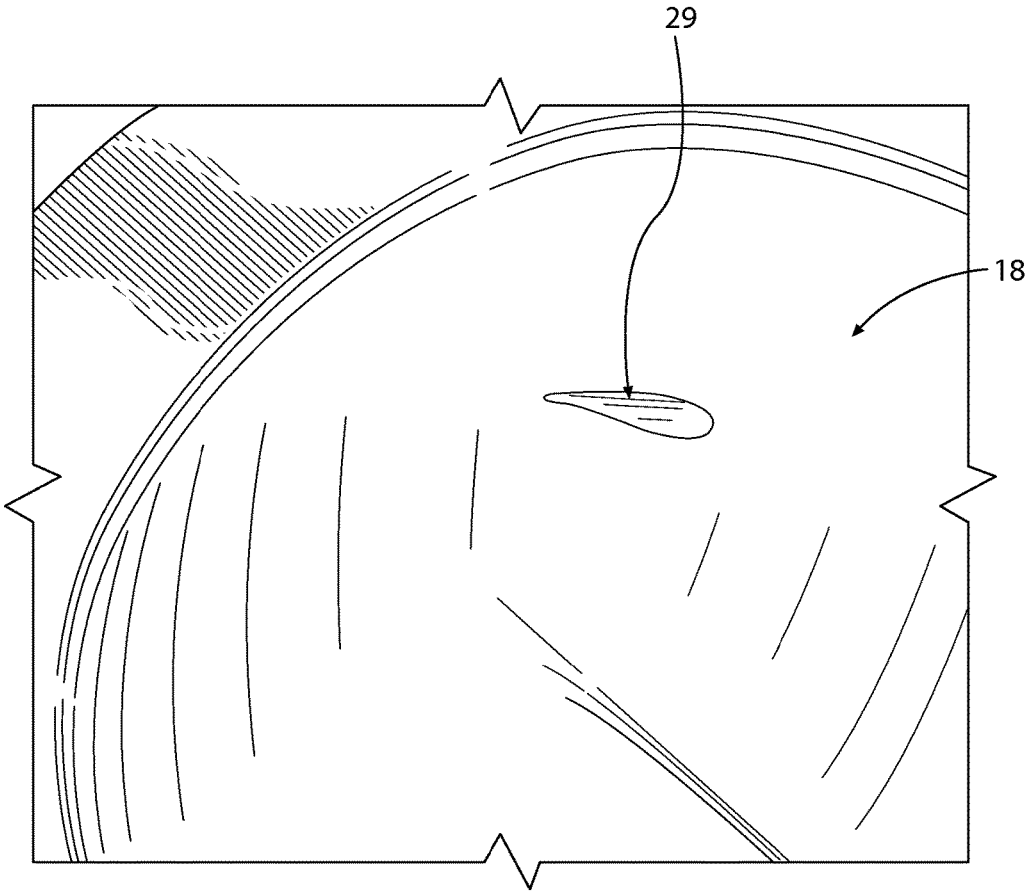
FIG. 19 is a detail view of a hole provided in a dual jet rimless toilet bowl, such as that shown in FIG. 5, according to an exemplary embodiment.

Referring to FIGS. 2-3 and 19, according to an exemplary embodiment, a plurality of holes are provided along a rear portion of the bowl 18. As shown in FIGS. 3 and 19, a side hole 29 (e.g., an aperture, jet, outlet, etc.) is disposed within a left and right side of the bowl 18. The side holes 29 may be in fluid communication with the inlet channel 38 (not shown in FIG. 3, but see, e.g., the cross-sectional view in FIG. 2) via separate channels (not shown). According to an exemplary embodiment, the side holes 29 are configured such that the holes do not project into the area defined by a curvature of the bowl 18. Thus, the curvature of the bowl 18 around the side holes 29 is continuous. Also, the holes 29 are configured so that an undercut is not provided thereunder, thereby preventing the accumulation (e.g., collection, build-up, etc.) of contamination below the holes 29. Also, in the event that any contamination does build up anywhere on the bowl 18, a user is able to visually see the contamination in order to clean the toilet assembly 8.

According to an exemplary embodiment, the side holes 29 are oriented such that water flowing therethrough is projected (e.g., directed, dispersed, etc.) forwardly and laterally across the surface of the bowl 18, thereby washing the bowl 18 and carrying waste toward an outlet hole 24. According to an exemplary embodiment, the side holes 29 and the channels connecting the holes 14,16 to the inlet channel 25 are configured so that a sufficient amount of water is introduced thereto during a flushing cycle in order to completely wash the bowl 18. For example, the size of the side holes 29 and the channels between the side holes 29 and the inlet channel 38 may be large enough to allow a sufficient (i.e., adequate) amount of water from the flushing cycle to flow therethrough in order for the bowl 18 to be completely washed. Although the Figures illustrate two side holes 29 disposed within a particular position of the bowl 18, it should be understood that a bowl member 10 may include a greater or fewer number of side holes, which may be disposed in different positions within a toilet bowl, according to other exemplary embodiments, and that the embodiments disclosed herein are not limiting.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the toilet as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A rimless toilet comprising:

a bowl having an opening, an outlet, and two jet holes positioned above a water line defined by a weir of a trapway, wherein the two jet holes are configured to introduce flush water into the bowl to evacuate waste from the bowl through the outlet into a drain;

wherein the toilet does not include an inwardly extending rim at the opening that overhangs an adjacent wall of the bowl;

wherein the two jet holes are positioned at a substantially similar height above the water line with a first of the two jet holes positioned in a front of the bowl and a second of the two jet holes is positioned in a rear of the bowl with each of the front and the rear jet holes located centrally between a left side and a right side of the bowl;

wherein the bowl includes only the two jet holes, a left side hole located in a rear left portion of the bowl, and a right side hole located in the rear right portion of the bowl; and wherein each of the two jet holes directs flush water toward a central portion of an outlet hole of a sump of the toilet without the flush water flowing over a portion of the bowl that is above the water line.

2. The toilet of claim 1, wherein the height of the two jet holes is less than half of a distance between the opening of the bowl and the water line, and wherein the left side hole and the right side hole are positioned at a substantially similar second height that is between the two jet holes and an upper surfaced of the bowl.

3. The toilet of claim 1, wherein the height of the two jet holes is less than one-third of a distance between the opening of the bowl and the water line measured up from the water line.

4. The toilet of claim 1, wherein the height of the two jet holes is less than one-quarter of a distance between the opening of the bowl and the water line measured up from the water line.

5. The toilet of claim 1, wherein the sump has a mouth cut-out, and a lowest point of the sump is located rearward of the mouth cut-out, whereby the sump is configured to allow gravity to assist the flow of waste to the outlet.

6. The toilet of claim 1, wherein the toilet does not include a rim channel for distributing flush water to the toilet.

7. The toilet of claim 1, wherein the bowl comprises an upper surface and the toilet further comprises a shroud having an upper surface and an upper cavity, wherein the bowl is configured to be received within the upper cavity and supported by the shroud, and wherein the bowl and the shroud are cooperatively configured such that the upper surfaces of the bowl and the shroud are essentially flush when the bowl is supported on the shroud.

8. A toilet comprising:

a bowl having an upper surface, an opening, and an outlet, the bowl including only two jet holes configured to direct flush water toward an outlet hole of a sump, a left side rear hole, and a right side rear hole, wherein a first of the two jet holes is positioned toward a front of the bowl, a second of the two jet holes is positioned toward a rear of the bowl, and the left and right side holes are positioned above the two jet holes; and a shroud having an upper surface and an upper cavity;

wherein the bowl is received within the upper cavity and supported on the shroud;

wherein the bowl and the shroud are cooperatively configured such that the upper surfaces of the bowl and the shroud are flush when the bowl is supported on the shroud; and wherein the toilet does not include an inwardly extending rim at the opening that overhangs an adjacent wall of the bowl.

9. The toilet of claim 8, wherein the two jet holes are configured to direct flush water toward a central portion of the outlet hole of the sump of the toilet without flowing over a portion of the bowl that is above a water line.

10. The toilet of claim 8, wherein an inlet channel used to supply water to the bowl is in fluid communication with the second jet hole and with a pair of channels that extend around a left and right side of the bowl; and wherein the pair of channels and the first jet hole are in fluid communication.

11. The toilet of claim 8, wherein the bowl further includes a jet hole positioned above a water spot defined by a weir of a trapway, the jet hole being configured to evacuate waste from the bowl into a drain.

12. The toilet of claim 8, wherein cooperatively configured mating surfaces are provided on an upwardly-facing surface of the shroud and a downwardly-facing of the bowl.

13. The toilet of claim 8, wherein a rear wall of the shroud is configured to be mounted to a wall.

14. The toilet of claim 8, wherein the shroud contacts a trapway at a first location, which is proximate to the outlet of the bowl, and at a second location, which is proximate a weir, to support the trapway.

15. The toilet of claim 8, wherein the shroud includes a rear cavity, and when the bowl is received within the upper cavity of the shroud, a trapway and an inlet channel of the bowl are accessible through the rear cavity.

16. A toilet comprising:

a bowl having an upper wall, an opening in the upper wall, and an outlet; and a shroud separate from the bowl and having an upper surface and a cavity;

wherein the bowl is configured to be received within the cavity and supported on the shroud;

wherein the upper surface of the shroud does not overhang a portion of the bowl, and the toilet does not include an inwardly extending rim at the opening that overhangs an adjacent wall of the bowl; and wherein the bowl includes only two jet holes, a left side rear hole, and a right side rear hole for directing flush water into the bowl, the left and right side holes are positioned above the two jet holes, a first of the two jet holes is located toward a front of the bowl, and a second of the two jet holes is located toward a rear of the bowl.

17. The toilet of claim 16, wherein the upper wall of the bowl extends outwardly from the opening to an outer edge, and wherein the outer edge of the upper wall is configured to be supported on the upper surface of the shroud.

18. The toilet of claim 17, wherein the upper wall of the bowl and the upper surface of the shroud are essentially flush when the bowl is supported on the shroud.

19. The toilet of claim 16, wherein the two jet holes are positioned less than two inches above a water spot defined by a weir of a trapway, the two jet holes being configured to evacuate waste from the bowl into a drain.

20. The toilet of claim 19, wherein the rear jet hole is slot-shaped.

21. The toilet of claim 16, wherein the toilet includes a sump having a mouth cut-out, and the lowest point of the sump is located rearward of the mouth cut-out, whereby the sump is configured to allow gravity to assist the flow of waste to the outlet.

* * * * *